United States Patent [19]

Barwise et al.

[11] 4,431,039

[45] Feb. 14, 1984

[54] INVOLUTED DISC SLICER

[75] Inventors: Robert D. Barwise, Bovey, Minn.; Rodger A. Arola; Edsel D. Matson, both of Hancock, Mich.

[73] Assignee: The United States of America as represented by the Secretary of Agriculture, Washington, D.C.

[21] Appl. No.: 352,661

[22] Filed: Feb. 26, 1982

[51] Int. Cl.[3] ..... B27L 11/02

[52] U.S. Cl. ..... 144/176; 144/246 C; 144/370; 144/246 F; 241/280

[58] Field of Search ..... 144/176, 188, 218, 237, 144/240, 235, 242, 181, 369, 370, 373, 374; 241/278 R, 280

[56] References Cited

U.S. PATENT DOCUMENTS 4,282,910 8/1981 Kipela et al. ..... 144/188

*Primary Examiner*—Francis S. Husar
*Assistant Examiner*—Jorji M. Griffin
*Attorney, Agent, or Firm*—M. Howard Silverstein; David G. McConnell

[57] ABSTRACT

A comminuting apparatus for reducing trees or portions thereof to particles of engineered length especially suitable for ring flaking for subsequent use in flakeboard fabrication and for use by utilities and industries using wood for energy production. The apparatus utilizes one or two rotating discs to which one on a plurality of curved cutting members are mounted and which severs trees, tree portions or other fibrous masses fed at right angles to a rotating shaft member. By the precise design of cutting members mounted on the rotating disc or discs, wood particles of engineered length are produced.

20 Claims, 3 Drawing Figures

INVOLUTED DISC SLICER

BACKGROUND OF THE INVENTION

1. Field of the Invention

This invention relates to a wood slicer apparatus for reducing trees, portions thereof or other fibrous masses into blocks of segments of engineered length and cross-sectional area. These fiber masses are produced for subsequent utilization in the wood fiber using industry for the manufacture of fiber-based products such as flakeboard or as a wood fuel of preferred particle size for the generation of heat, steam or electricity.

2. Description of the Prior Art

Over the years several concepts have been developed to reduce total trees or portions thereof to common pulp chip size particles for the pulping industry; however, the chipping apparatus of these machines is typically angularly disposed with reference to the logitudinal posture of the fiber mass, thereby producing a chip cut obliquely to the fiber length. Further, these chippers have very limited control over dimensional quality of the chips produced. This is true in both thickness and profile. Another undesirable quality of these chips is the disproportionate amount of short fibers and fines produced by this method of chipping. While chips with these irregularities have been acceptable to the pulp industry, they are generally unacceptable for certain fiber-using industries such as the flakeboard industry. These conventional pulp chips are so short in length relative to width and thickness that flaking them "along the grain" with existing flakers is impossible. Ring flaking, as used herein, consists of exposing sections of wood fiber to a set of rotating flaker knives to produce elongated flakes cut parallel to the wood fiber There are several ring flakers commercially available, for instance, under the trade names Pallmann Flaker or Black and Clawson Flaker and form no part of this invention.

A concept developed by scientists at the U.S. Forest Service's Forest Products Laboratory in Madison, Wisconsin calls for the production of long, thin particles called "fingerlings". Fingerlings are defined as wood particles or blocks approximately 2½ to 3 inches long in the fiber direction with an idealized cross-section of one inch by one inch. These blocks having a predominant length along the grain direction can be ring flaked into long relatively narrow flakes of controlled thickness. The resulting flakes, after mixing with resin, can be arranged in a random-oriented or aligned mat and pressed into flakeboard or other composite wood products having the desired engineered properties.

The commercial development of the "fingerling" concept for producing flakeboard is dependent on the ability to mechanically produced the fingerling particles from small diameter trees or portions thereof for ultimate ring flaking. A suitable commercial machine for producing fingerling particles is not available. It should be stated that several flaking machines are commercially available which produce flakes of a quality accepted by the present day flakeboard industry. However, these flakes are necessarily produced from relatively large straight tree stems which is contradictory to a purpose of this invention. That purpose being the utilization of otherwise non-merchantable wood fiber such as small diameter trees, logging residues, or precommercial thinnings.

Flakeboard is ideally comprised of plys or layers of flakes wherein all fibers of one ply are aligned in a single direction with the fibers of each succeeding ply being disposed at right angles to the preceeding ply to attain maximum strength and rigidity in the finished product. This composition can best be accomplished by using elongated flakes which can be readily aligned and compacted to minimize voids within the plys thereby maximizing the structural integrity and conserving resin.

In addition, as a result of the well recognized need to conserve energy, the ever spiralling prices of conventional fossil fuels and the declining availability of these fuels, considerable attention has been given to using wood from small diameter, poor quality, noncommercial or otherwise under utilized trees, e.g., using logging residues and other "junk fiber" as an alternate or supplemental fuel. Those industries now using or considering the use of such forest resources as a source of energy presently have little choice in the geometry of the wood particles used in their combustion equipment. The present state-of-the-art dictates the use of conventional whole-trees chipping equipment to fill their needs. Though somewhat satisfactory and and capable of being readily burned in various solid fuel combustors, conventional pulp-sized chips have certain inherent disadvantages due to their small particle size and geometry.

Moreover, conventional pulp-sized wood chips are relatively flat in shape. When stored in a pile, they tend to layer naturally. An analogy might be drawn to a pile of poker chips or to scales on a fish. This flat layering of the pulp sized chips in a storage pile or container allows for little movement of air which would facilitate natural drying. For similar reasons, efficient pile or layer burning on traveling grates of pulp-sized chips is adversely affected, i.e., the close layering of wood chips inhibits the flow of underfire combustion air required for efficient and complete combustion. In relation to pile burning in a combustor, experience has shown that a fire in a storage pile of chips will be confined to the outer layers of the pile due to the lack of sufficient combustion air below the surface of the pile.

Also, since conventional pulp chips are of relatively small particle size when stored in loose storage piles, they have a low bulk density, substantial space is required for bulk storage.

Although a wide variety of solid fuel combustors are capable of burning pulp-sized chips, the resulting flue gases will contain substantial amounts of fines or small chip particles. In typical industrial-sized combustors, flue gas velocities of considerable magnitude exist. These high flue gas velocities can carry unburned particles and fly ash up the stack. Since environmental regulations mandate control of such solid particulate emissions, the industrial energy plant or utility burning pulp-sized wood chips must install extremely costly solid particulate emissions control equipment.

Inasmuch as stoker sized coal and wood chips are both solid fuels requiring large combustion chambers, it is logical to consider supplementing coal with wood chips when economic feasibility and wood availability are satisfied. In practice, it would be ideal if the residence or combustion time of the stoker-sized coal and wood particles were of near equal duration. However, this is not the case with pulp-sized wood chips which coombust at a much faster rate than the stoker-sized coal.

A review of available wood cutting or chipping devices indicates that existing technology produces only short, random-length chips and not the desired fingerling particles or large blocks.

U.S. Pat. No. 3,407,854 is exemplary of the many cutting and chipping devices known in the prior art which employ a generally cylindrical feed guide to a wood chipping apparatus. In such devices, the feed guide is parallel to the axis of rotation of the chipping implement.

A disc cutter utilizing an arcuate cutting member is descibed in U.S. Pat. No. 4,106,537. The device of this reference utilizes a single cutting member which increases in height from a lowermost point near the periphery of the disc. The entire cutting member extends about the periphery of the disc and thus constitutes a significantly different arrangement than the discs of the above-cited patents.

A chipping machine employing a special cutting device as a part of the helical head chipper for producing fingeling particles is described in U.S. Pat. No. 4,053,004. Test reports and illustrations of this device appear in U.S. Forest Service Reasearch Paper INT-200, "Converting Forest Residues to Structural Flakeboard—The Fingerling Concept" and "Exploratory Trials with a Spiral-Head Chipper to Make Hardwood 'Fingerlings' Chips for Ring Flakers," by J. R. Erickson, FPRS Journal, Vol. 26, No. 6, p. 50–53.

Depending upon the wood species being chipped, this device reduces small diameter trees or portions thereof into fingerling sized particles or blocks ranging in size from fingerlings up to blocks equal in cross section to the fiberous workpiece and of length equal to the flight spacing of the spiral or helical cutting head.

An alternative to this helical head chipping device has been sought which would, (1) accept work pieces of greater cross sectional area, (2) increase throughput, and (3) result in less specific input power requirements.

SUMMARY OF THE INVENTION

Accordingly, it is an object of the present invention to provide a disc slicer for producing fingerling particles and blocks having fiber lengths suitable for ring flaking.

It is a further object of the invention to provide a disc slicer for producing preferred wood particles of a size large enough to be suitable for combusting in solid fuel combustors.

It is a still further object of the invention to provide a device for reducing small diameter trees and logging residues into particles of preferred shape and size.

It is still a further object of the invention to provide a device for efficiently utilizing small diameter, poor quality, or otherwise non-merchantable and under utilized forest resources including logging residues and pre-commercial thinnings.

It is still a further object of the invention to provide a device for reducing sawmill slabs, edgings and other mill residue into particles of preferred shape and size.

It is a still further object of the invention to provide a method for reducing small diameter trees and logging residues into particles of a preferred shape and size and for efficiently utilizing small diameter or poor quality or otherwise non-commercial under utilized forest resources.

It is a still further object of the present invention to provide a method and apparatus to reduce logging operation wastes and to render logging operations esthetically and environmentally more acceptable.

It is a still further object of the present invention to provide a device that produces wood fiber segments of a preferred length and has a small enough bulk, weight and power requirements that it can be brought to the site of logging operations or logging residue collection and operated at that site, thereby reducing the problems of transporting bulky, irregularly shaped residue.

To achieve the foregoing and other objects and, in accordance with the purpose of the present invention as embodied and broadly described herein, the disc slicer of this invention may comprise a device wherein small diameter trees or portions thereof or other fiber mass are fed through a feed tube mounted perpendicular to the shaft to which at least one disc is mounted. The disc carries at least one, but preferably a plurality of curved cutting blades. The cutting blades are mounted on the disc, which is preferably a steel plate, in such a manner that the curved plane of rotation of the blade edge or edges is parallel to the axis of rotation of the shaft. The cutting blades are designed to have a continually increasing depth such that the blades start from zero depth at the leading edge up to a maximum depth at the trailing edge corresponding to the diameter of the fiber mass being severed.

The blade or blades are mounted on the disc so that as the disc rotates, a cutter blade engages the workpiece, i.e., fiber mass, at the point of minimum blade depth. As rotation continues, the curved blade travels through the stationary workpiece up to the maximum blade depth (or workpiece diameter if less than maximum blade depth). The curved blade or blades are positioned so that the point of zero blade depth is radially further from the shaft axis of rotation than from the point of maximum depth. This positioning resembles that of a segment of an involute. With these blade positioning characteristics, as the disc rotates and the cutter blade or blades travel through the workpiece, the blades try to pull the workpiece radially inward by a distance equal to the difference between the radial distances of the points of minimum and maximum blade depth. However, because the particle being severed lacks rigidity, it tends to produce laminar splits. These splits facilitate further breakdown of the severed particles if desired. To insure positive feeding of the workpiece into the severing apparatus, feed rolls or other feed means are required. Thus repeated severing of cross sections of the workpiece continues as the disc rotates until the entire workpiece is reduced to the desired particles. The linear rate of reducing the workpiece to particles of engineered length is directly related to the speed of rotation of the cutters, the number of cutters and to a lesser extent, the auxillary feed rate.

In a further aspect of the invention, the disc slicer may utilize two discs spaced apart by a distance at least equal to the maximum diameter of the workpiece to be severed. Each pair of cutting blades are oppositely positioned on the discs in substantially a mirror image. This type of spaced double disc apparatus is advantageous wherein the mirrored blades produce a more stable blade configuration as opposed to a single disc, and produces pure torsional loading on the drive shaft rather than torsional plus axial thrust.

In either embodiment, the leading edge of each curved cutting blade is attached to the disc closer to the periphery of the disc than is the trailing edge of the blade. The leading edge of each blade preferably has a cutting depth approaching zero and a trailing edge having a maximum cutting depth. The curved blades are mounted such that the radius between the curved blade with respect to the center of the disc is equal to the target length of the severed fiber segment. As explained hereinafter, the mounting disc(s) are suitably attached to and rotated by a shaft which in turn is rotated by a suitable power means.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

The above-noted embodiments of the invention are disclosed in greater detail in the following and are illustrated in the drawings as follows.

DESCRIPTION OF THE PREFERRED EMBODIMENTS

The apparatus for involute fiber shear is preferably of two general designs, the single disc or the double disc.

Figure 1:
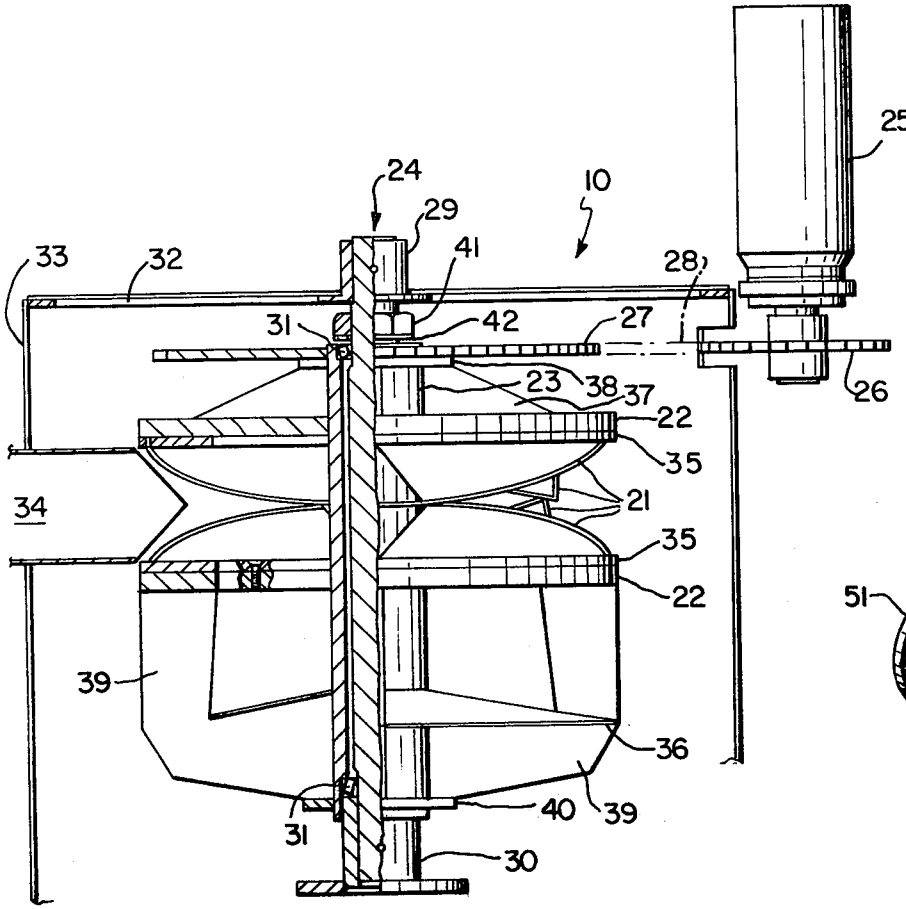
FIG. 1 illustrates a cross-section of the double involute disc slicer of the invention.

Turning to FIG. 1, there is depicted a cross-sectional view of a double disc slicer according to the present invention.

While the cutting members of the disclosed double disc apparatus are shown rotating about a vertical axis in FIG. 1, it should be understood that they can be positioned in other planes as well.

In FIG. 1, the apparatus referred to as an involute disc slicer is generally denoted as 10. It comprises at least one cutting blade 21 attached to each rotatable disc 22 which in turn is attached to a demountable tube or hub 23. It will be understood that more than one blade 21 can be positioned on each disc 22. This rotatable assembly is supported in the illustrated embodiment by shaft 24 and rotated by power means 25 through, for example, sprockets 26 and 27 and sprocket chain 28 (shown only in phantom).

In order to adjust the speed of rotation of the discs, the sprocket and chain drive may be arranged to include sprockets of various diameters, both on the shaft and power means. By combining various sprockets, the speed of the shaft rotation can be adjusted in a manner similar to a multi-speed bicycle. Alternatively, an arrangement of pulleys and belts or a variable speed drive means can be used. Shaft 24 extremeties are contained and supported by retaining collars 29 and 30. Tube 23 is supported on shaft 24 by low friction bearings 31. Shroud 33 and shroud cover 32 support the infeed tube and retaining collar 29 respectively while containing the sheared fibers and causing them to be fed onto an off-loading apparatus or into a storage area.

Figure 2:
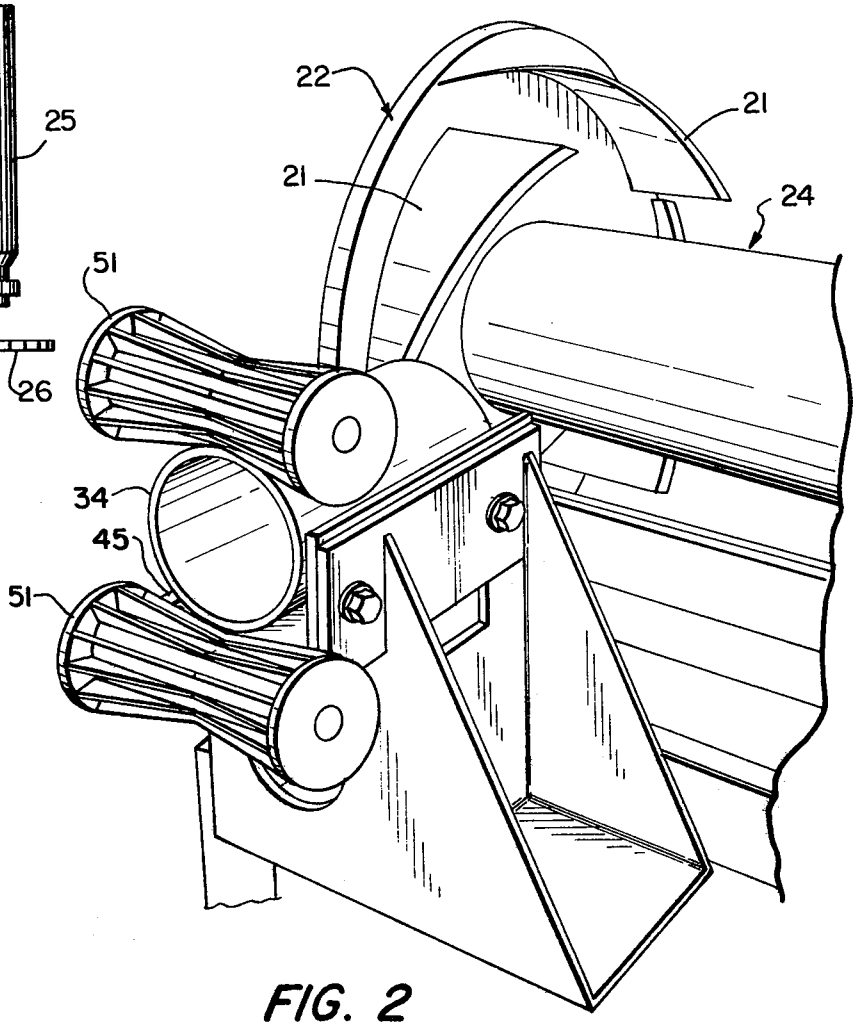
FIG. 2 provides a perspective view of a portion of the involute disc slicer apparatus particularly illustrating a single disc.

The apparatus of the present invention as illustrated in FIG. 1 shows four pairs (for a total of eight) cutting blades 21 attached to mounting ring segments 35 which are demountably attached, for example, by bolting to the spaced-apart discs 22. The bottom disc 22 in FIG. 2 is open-centered to permit the sheared fiber segments to fall onto a traverse pan 36. The top disc 22 in FIG. 1 is attached to the general support structure by gusset-like rib members 37 and top support ring 38, all of which are attached to tube 23. Bottom disc 22 and traverse pan 36 are attached to tube 23 by support brackets 39 and bottom support ring 40. Nut 41 and washer 42 preload bearings 32 of the rotatable assembly. Sprocket 27 can be demountably attached to tube 23 through suitable fasteners onto top support ring 38.

Figure 1A:
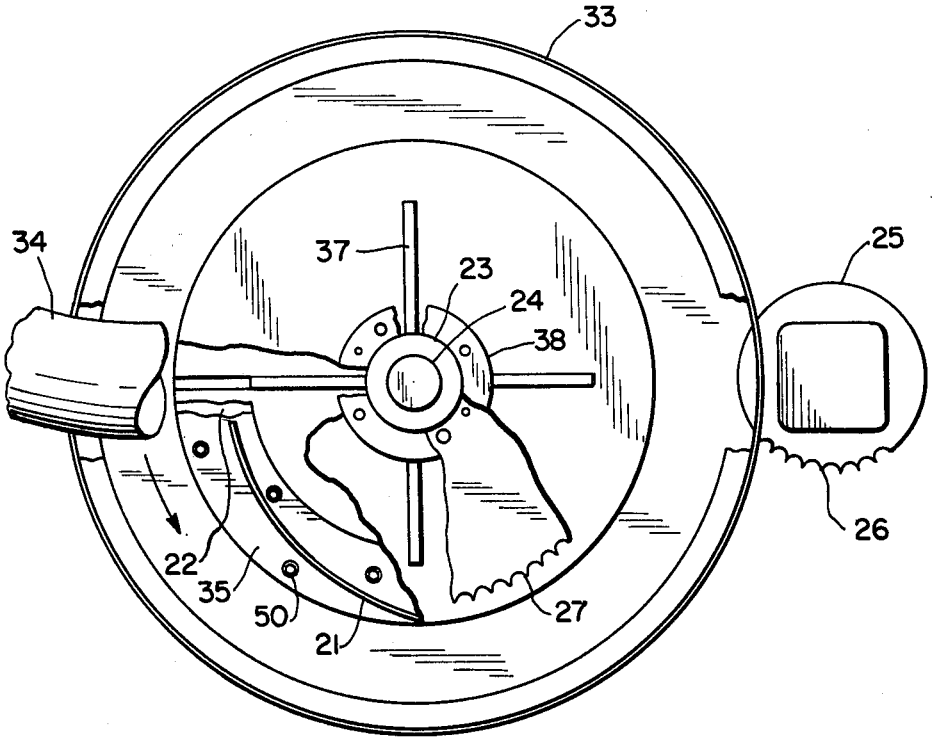
FIG. 1A is a plan view of the embodiment of FIG. 1 with certain sections cut away.

Turning now to FIG. 1A, there is illustrated a partial cutaway plan view of the embodiment of FIG. 1 in which similar elements bear the same numerals as in FIG. 1. The gusset-like rib member 37 can be seen attached to support ring 38. The shroud 33, through which passes feed tube 34 can also be more clearly viewed in FIG. 1A. Mounting rings 35 are shown detachably mounted onto disc 22, by for instance, bolt members, e.g., 50. It should be understood that any secure but detachable mounting means will serve equally well. As can be clearly seen in FIG. 1A, the blades 21 are involute with the portion of the cutting edge closest to the periphery of the disc 22 (the leading edge) having an edge depth approaching zero and the portion of the cutting edge furthest from the periphery of the disc 22 (the trailing edge) having the maximum edge depth.

In operation the workpiece, i.e., fiber mass may be mechanically or gravity fed depending on the design or physical orientation of the slicing apparatus.

Power is transmitted to the shaft 24 by the power means 25, for example, a hydraulic motor which may be in the form of hydraulic pressure developed by a hydraulic pump and converted into torque by said hydraulic motor. It should be understood that other power means including, but not limited to, electric, diesel or gasoline motors may be used to develop the necessary torque. This torque is then transmitted to the rotatable portion of the apparatus through sprockets 26, 27 and sprocket chain 28 or other suitable means for transmitting power to the shaft. The workpiece or fiber mass to be severed is fed through the infeed tube 34 and is contacted by the rotating cutting blades 21. The workpiece is severed by the rotation of the cutting blades. As lengths of workpiece are severed they fall through the open center of bottom disc 22 and are carried off the traverse pan 36 by inertia onto an off-loading assembly (which forms no part of the present invention) or into a storage area. Shroud 33 and shroud cover 32 act as an upper support for shaft 24 and tube 34 and as a safety device and as a housing for the severed particles.

Turning now to FIG. 2, there is illustrated an involute disc slicer of the single disc design. The device comprises at least one (but preferably more) curved cutting blades 21 attached to a rotatable disc 22 which in turn is suitably attached to a hub such as hub 23 in FIG. 1. This entire assembly of the cutting blade or blades, rotatable disc and hub mounted on and supported by a shaft 24 which is rotated by a power means such as the power means 25 of FIG. 1. This part of the embodiment of FIG. 2 is similar to the embodiment of FIG. 1 and need not be additionally described. Also in a manner similar to that illustrated in FIG. 1 shroud 32 and feed tube 34 is provided for the single disc assembly. It is preferred that the single cutting blade 21 or the plurality of equally spaced curved cutting blades 21 are attached to a mounting ring (similar to that indicated by the numeral 35 in FIG. 1) which in turn are demountably attached to disc 22 by, for example, equally spaced mounting bolts (not shown). An anvil 45 is suitably placed with regard to feed tube 34 to provide clearance between the feed tube and blades 21. Suitable rolls 51 are provided to mechanically feed the workpiece into the cutter(s) 21.

In operation of the embodiment of FIG. 1, the workpiece may be fed mechanically by spiked or ribbed rolls 51 or even gravity fed depending on circumstances and design. The single disc of FIG. 2 replaces the two discs described in FIG. 1, all other components of the apparatus and, therefore, operation being similar to that of FIG. 1. No additional description of the operation is, therefore, necessary. The severed fiber masses from the single disc machine are free to gravity discharge from the open face of the cutter disc.

The volumetric output of the disc slicer of the present invention, which severs the workpiece into segments of predetermined length, may be varied to suit the intended application. The disc slicer output is directly related to the blade mounting configuration, speed of rotation, and the number of cutting members acting on the fiber mass per revolution of the rotating assembly, and to a lesser extent the feed rate. For example, if it is presupposed that three cutting members are mounted at equal spacing on a disc and positioned in such a manner as to cut three-inch segments, each full rotation of the severing apparatus assembly would then produce three entirely severed segments three inches long for a total of nine inches removed per revolution. If only a single cutting member was positioned on the disc, there would be just one severing action per revolution totalling three inches removed per revolution.

The foregoing description of the preferred embodiment of the invention has been presented for purposes of illustration and description. It is not intended to be exhaustive or to limit the invention to the precise form disclosed, and obviously many modifications and variations are possible in light of the above teaching. For example, the manner of powering the shaft or the geometry and nature of the workpiece fed or the angle between the trailing edge of the cutting blade and the disc, the embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A slicing device for reducing a workpiece into blocks of engineered length comprising:

a rotatable shaft means having an axis of rotation;

at least one generally circular disc carried on said shaft means and generally perpendicular thereto for rotation therewith;

at least one curved cutting blade attached to said disc and having a cutting edge comprising an involute segment radially spaced from said shaft and positioned on said blade generally opposite from said disc;

power means for rotating said shaft;

feed means mounted proximate to said cutting blade for feeding said workpiece generally perpendicularly to said shaft.

2. The apparatus of claim 1 wherein said involute cutting edge has a leading edge with a cutting depth approaching zero and a trailing edge with a cutting depth at least equal to the size of said workpiece to be reduced.

3. The apparatus of claim 1 wherein a plurality of equally spaced curved cutting blades are attached to said disc.

4. The apparatus of claim 3 wherein each cutting member has a trailing edge with a cutting depth sufficient to sever the entire workpiece.

5. The apparatus of claim 4 wherein said power means is a mechanical drive means.

6. The apparatus of claim 5 wherein said mechanical drive means is an electric motor.

7. The apparatus of claim 5 wherein said mechanical drive means is a hydraulic motor.

8. The apparatus of claim 5 wherein said rotatable shaft includes bearings.

9. The apparatus of claim 3 wherein the slicing device comprises two discs, each of said discs having a plurality of curved cutting blades.

10. The apparatus of claim 9 wherein said feed means comprises a feed tube having a diameter and said discs are arranged with opposing cutting blades, each of said cutting blades having a trailing edge of a depth of at least half the diameter of said feed tube.

11. The apparatus of claim 1 or 10, wherein said feed means further comprises rollers for mechanically feeding the workpiece to said cutting blade.

12. The apparatus of claim 9 wherein at least one of said cutting blades is permanently attached to one of said discs.

13. The apparatus of claim 3 wherein said cutting blades are detachably mounted to said discs.

14. A method for reducing masses of elongate fibrous material having a grain direction into blocks of engineered size comprising:

feeding said elongate fibrous material into an apparatus having a generally circular disc rotating about an axis perpendicular to said axis of rotation, said disc having attached thereto at least one curved cutting blade with an involute cutting edge disposed generally orthogonally with respect to said grain direction;

rotating said disc through an angle sufficient to draw said involute cutting edge through said elongate material thereby severing a block of engineered size from said elongate material in a direction generally perpendicular to said grain direction.

15. The method of claim 14 wherein the step of feeding further comprises continuous feeding of said elongate material and the step of rotating further comprises continuously rotating said disc.

16. The method of claim 15 wherein said cutting blade causes said elongate material to be severed from the workpiece and causes it to exhibit internal laminar fracturing.

17. The method of claim 16 wherein said severing and fracturing action occurs simultaneously to produce severed blocks of engineered length.

18. The method of claim 17 wherein said cutting member has a leading edge and a trailing edge and the step of severing a block of engineered length includes positioning said cutting member on said disc so that said leading edge of said cutting member is radially closer to the periphery of said disc than said trailing edge.

19. The method of claim 18 wherein said disc has a controlled speed of rotation and the rate of reducing said mass is a function of at least the speed of rotation, and the positioning of said cutting member, and to a lesser extent the feed rate.

20. The method of claim 19 wherein each disc carries a plurality of cutting members and the rate of reducing said mass is additionally a function of the number corresponding to said plurality of cutting members.

* * * * *